US005299337A

United States Patent [19]

Venza

[11] Patent Number: 5,299,337

[45] Date of Patent: Apr. 5, 1994

[54] PORTABLE BEACH LOUNGE AND METHOD

[76] Inventor: Lynelle Venza, 10295 Collins Ave., Apartment 1010-N, Bal Harbor, Fla. 33154

[21] Appl. No.: 972,438

[22] Filed: Nov. 6, 1992

[51] Int. Cl.[5] ..... A47C 16/00

[52] U.S. Cl. ..... 5/656; 5/418; 5/462; 297/17; 297/184.15; 190/2

[58] Field of Search ..... 5/417–420, 5/462, 465, 633, 656, 638, 645; 190/2; 297/17, 184

[56] References Cited

U.S. PATENT DOCUMENTS

| | | | |
|---|---|---|---|
| 2,512,806 | 6/1950 | Neiborn | 155/45 |
| 2,857,957 | 10/1958 | Gay | 5/420 X |
| 3,120,404 | 2/1964 | Bramming | 297/118 |
| 3,139,632 | 7/1964 | Johns | 5/462 X |
| 3,179,465 | 4/1965 | Roberts | 297/17 |
| 3,333,286 | 8/1967 | Biolik | 5/639 X |
| 3,560,047 | 2/1971 | Davis | 297/188 |
| 3,947,903 | 4/1976 | Menke | 5/111 |
| 4,064,580 | 12/1977 | Ezekoye | 5/633 X |
| 4,079,992 | 3/1978 | Thrift | 297/183 |
| 4,141,585 | 2/1979 | Blackman | 297/180 |
| 4,258,951 | 3/1981 | Groom | 297/16 |
| 4,425,675 | 1/1984 | Victor | 5/418 X |
| 4,474,407 | 10/1984 | Nazar | 297/192 |
| 4,634,175 | 1/1987 | Wise | 297/183 |
| 4,639,958 | 2/1987 | Lerner | 5/418 |
| 4,650,245 | 3/1987 | Nazar | 297/192 |
| 4,652,048 | 3/1987 | Nazar | 297/192 |
| 4,687,248 | 8/1987 | Ross | 297/129 |
| 4,775,182 | 10/1988 | von Hoffman | 297/45 |
| 4,793,012 | 12/1988 | LaPorte | 5/420 |
| 4,802,249 | 2/1989 | Bills | 5/420 |
| 4,890,882 | 1/1990 | Harrington | 297/45 |
| 4,978,166 | 12/1990 | James | 297/184 |
| 5,029,350 | 7/1991 | Edelson | 5/431 |
| 5,096,257 | 3/1992 | Clark | 297/184 |
| 5,121,961 | 6/1992 | Marshall | 297/17 |

FOREIGN PATENT DOCUMENTS

| | | | |
|---|---|---|---|
| 34900 | 3/1886 | Fed. Rep. of Germany | 5/639 |
| 2589702 | 5/1987 | France | 5/419 |

*Primary Examiner*—Michael F. Trettel
*Attorney, Agent, or Firm*—Frank L. Kubler

[57] ABSTRACT

A portable chair includes a first container for retaining items, the first container having an inclined top wall for use as a back rest. The chair may additionally include a second container for retaining items, the second container having an inclined top wall and being hingedly connected to the first container such that the first container can pivot onto the inclined top wall of the second container, such that the inclined top wall of the second container can be pivoted into alignment with the inclined top wall of the first container, for use together as a back rest, and a third container for retaining items, the third container having a substantially horizontal top wall and being connected to the second container such that the second container can pivot together with the first container onto the substantially horizontal top wall of the third container. An access opening is preferably provided in at least one container. A canopy assembly is optionally provided over the containers. Also optionally included is a shoulder strap for use in carrying the portable chair. A method of closing the chair for transport and storage includes the steps of pivoting the first container onto the second container, and pivoting the first and second containers onto the third container. A method of opening the chair for use includes the steps of pivoting the first and second containers off the third container and against the ground, and pivoting the first container off the second container and against the ground.

12 Claims, 4 Drawing Sheets

PORTABLE BEACH LOUNGE AND METHOD

BACKGROUND OF THE INVENTION

1. Field of the Invention

The present invention relates generally to the field of chairs for use on beaches, and more specifically to a beach lounge formed of a series of hingedly connected carrying containers which can be pivoted into an open position for use, and into a closed position for carrying and storage, which when open takes the form of a first container having an inclined top wall, hingedly joined to a second container having an inclined top wall, hingedly joined to an essentially cubical third container having a horizontal top wall, the inclined top walls of the first and second containers aligning to form a continuous surface sloping downward from the top of the third container to the ground for use as a back rest, the chair being closed by pivoting the top wall of the first container onto the top wall of the second container, and then by pivoting the first and second containers onto the top wall of the third container, the first and second containers each having an access opening covered with a split, flexible sheet, and the third container being an insulated cooler with a flush lid, the lounge including a canopy mounted at one end to a pair of first elongate members pivotally joined to opposing sides of the first container, and mounted at the other end to a pair of second elongate members pivotally joined to the first elongate members, the first and second elongate members being pivoted to open and close the canopy over the back rest, and including a shoulder strap attached to opposing sides of the third container for carrying the lounge.

2. Description of the Prior Art

There have long been portable chairs for use outdoors and specifically on beaches, one general category of prior art portable chairs might group those having foldable frames covered with supporting sheets or strips. These chairs can deteriorate in the sun and can fail to provide firm, healthful support for the back. Many of these chairs also fail to provide retaining compartments for carried items. An example is Groom, U.S. Pat. No. 4,258,951, issued on Mar. 31, 1981. Groom discloses a portable, collapsible chair having a complex and expensive support frame. Arms and legs pivot out from two hinge points in spider fashion and a hammock sheet is suspended between two ends. Harrington, U.S. Pat. No. 4,890,882, issued on Jan. 2, 1990, discloses a collapsible beach chair. Von Hoffman, U.S. Pat. No. 4,775,182, issued on Oct. 4, 1988, discloses a foldable beach chair with a frame which can be folded and telescoped into a narrow configuration to fit into a carrying tube. James, U.S. Pat. No. 4,978,166, issued on Dec. 18, 1990, teaches a sunshade for use on a child restraining car seat. A canopy is mounted on a plurality of hoop-shaped ribs which fan apart on pivot elements. Clark, U.S. Pat. No. 5,996,257, issued on Mar. 17, 1992, discloses a sunshade apparatus for clamping onto the back of a recreational chair. Two support legs extend up from the top of the back rest and hingedly connect to a cantilevered canopy structure.

Some sheet and frame chairs do provide carrying compartments, but the capacity of the compartments is invariably too small to carry most items needed for an outing. An example is Ross, U.S. Pat. No. 4,687,248, issued on Aug. 18, 1987, which teaches a sheet and frame chair which can be folded into a carrying satchel.

LaPort, U.S. Pat. No. 4,793,012, issued on Dec. 27, 1988, reveals a beach mat adapted for use on a lounge chair, which can be folded several times for carrying, and has a flap to receive articles. Menke, U.S. Pat. No. 3,947,903, issued on Apr. 6, 1976, discloses a chair having back rest and leg support segments which fold over a central segment on which items can be placed. Then side sheet portions fold laterally over the top of these segments and are joined with a zipper fastener. Roberts, U.S. Pat. No. 3,179,465, issued on Apr. 20, 1965, teaches a convertible beach chair, suit case combination. A complicated and expensive frame structure folds into an elongate box. Bramming, U.S. Pat. No. 3,120,404, issued on Feb. 4, 1964, reveals a seat which folds to form a lunch box.

Then there are portable chairs having cushions supported by a folding frame. Some of the cushions contain carrying compartments, but the limited size of such cushions makes the compartments too small to carry many outing items. One such chair is disclosed in Nazar, U.S. Pat. No. 4,652,048, issued on Mar. 24, 1987, and in Nazar, U.S. Pat. No. 4,474,407, issued on Oct. 2, 1984, and in Nazar, U.S. Pat. No. 4,650,245, issued on Mar. 17, 1978. Nazar reveals a portable folding chair having a seat support platform containing an insulated vessel for retaining ice, beverages, or foodstuffs. Blackman, U.S. Pat. No. 4,141,585, issued on Feb. 27, 1979, discloses a folding, cooling lounge chair. The cushions are actually containers for dry ice or other coolant having fan circulation and vents, to draw heat away from the chair occupant. Thrift, U.S. Pat. No. 4,079,992, issued on Mar. 21, 1978, discloses a seat in the shape of a open sea shell having outer walls which support interior cushions. The shell outer walls and cushions pivot closed for carrying, and might possibly retain a few small items. Wise, U.S. Pat. No. 4,634,175, issued on Jan. 6, 1987, teaches a baby carrier formed of cushion member on supporting hoop members pivoting on a common axis. A pouch is provided underneath the cushion member. Edelson, U.S. Pat. No. 5,029,350, issued on Jul. 9, 1991, discloses a thick cushion hingedly connected to a thin cushion for cross-legged sitting. Davis, U.S. Pat. No. 3,560,047, issued on Feb. 2, 1971, teaches a portable chair having a seat cushion containing an insulated liquid container and dispenser. Marshall, U.S. Pat. No. 5,121,961, issued on Jun. 16, 1992, reveals a chair having a foldable series of support panels, which can collapse into a carrying configuration. Neiborn, U.S. Pat. No. 2,512,806, issued on Jun. 27, 1950, discloses a complicated frame and cushion assembly which folds into several reclined positions, one of which can serve as a bed.

It is thus an object of the present invention to provide a portable folding chair containing large capacity carrying compartments and including a horizontal surface for use as a table.

It is another object of the present invention to provide such a chair which is easy to open f or use and to close for carrying and storage.

It is another object of the present invention to provide such a chair which includes a shade-creating canopy.

It is still another object of the present invention to provide such a chair which provides firm, healthful back support.

It is finally an object of the present invention to provide such a chair which is simple and reliable in design and inexpensive to manufacture.

SUMMARY OF THE INVENTION

The present invention accomplishes the above-stated objectives, as well as others, as may be determined by a fair reading and interpretation of the entire specification.

A portable chair is provided, including a first container for retaining items, the first container having an inclined top wall for use as a back rest. The chair may additionally include a second container for retaining items, the second container having an inclined top wall and being hingedly connected to the first container such that the first container can pivot onto the inclined top wall of the second container, and such that the inclined top wall of the second container can be pivoted into alignment with the inclined top wall of the first container, for use together as a back rest. The portable chair may additionally include a second container for retaining items, the second container having a substantially horizontal top wall and being connected to the first container such that the first container can pivot onto the substantially horizontal top wall of the second container. As still another variation, the portable chair may include a second container for retaining items, the second container having an inclined top wall and being hingedly connected to the first container such that the first container can pivot onto the inclined top wall of the second container, such that the inclined top wall of the second container can be pivoted into alignment with the inclined top wall of the first container, for use together as a back rest, and a third container for retaining items, the third container having a substantially horizontal top wall and being connected to the second container such that the second container can pivot together with the first container onto the substantially horizontal top wall of the third container. An access opening is preferably provided in at least one container for inserting items into and taking items out of the at least one container, together with a resilient sheet having an access slit, for covering the access opening so that the items do not fall out. A canopy assembly is optionally provided and includes two first elongate members joined to opposing sides of a container, a sheet of flexible material for providing shade, and a mechanism for opening and closing the sheet over the first container. Also optionally included is a shoulder strap for use in carrying the portable chair. The third container preferably includes an insulated lining for keeping perishable items fresh and cooling beverages.

A method of closing the chair for transport and storage is provided, including the steps of pivoting the first container onto the second container, and pivoting the first and second containers onto the third container. A method of opening the chair for use is provided and includes the steps of pivoting the first and second containers off the third container and against the ground, and pivoting the first container off the second container and against the ground.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
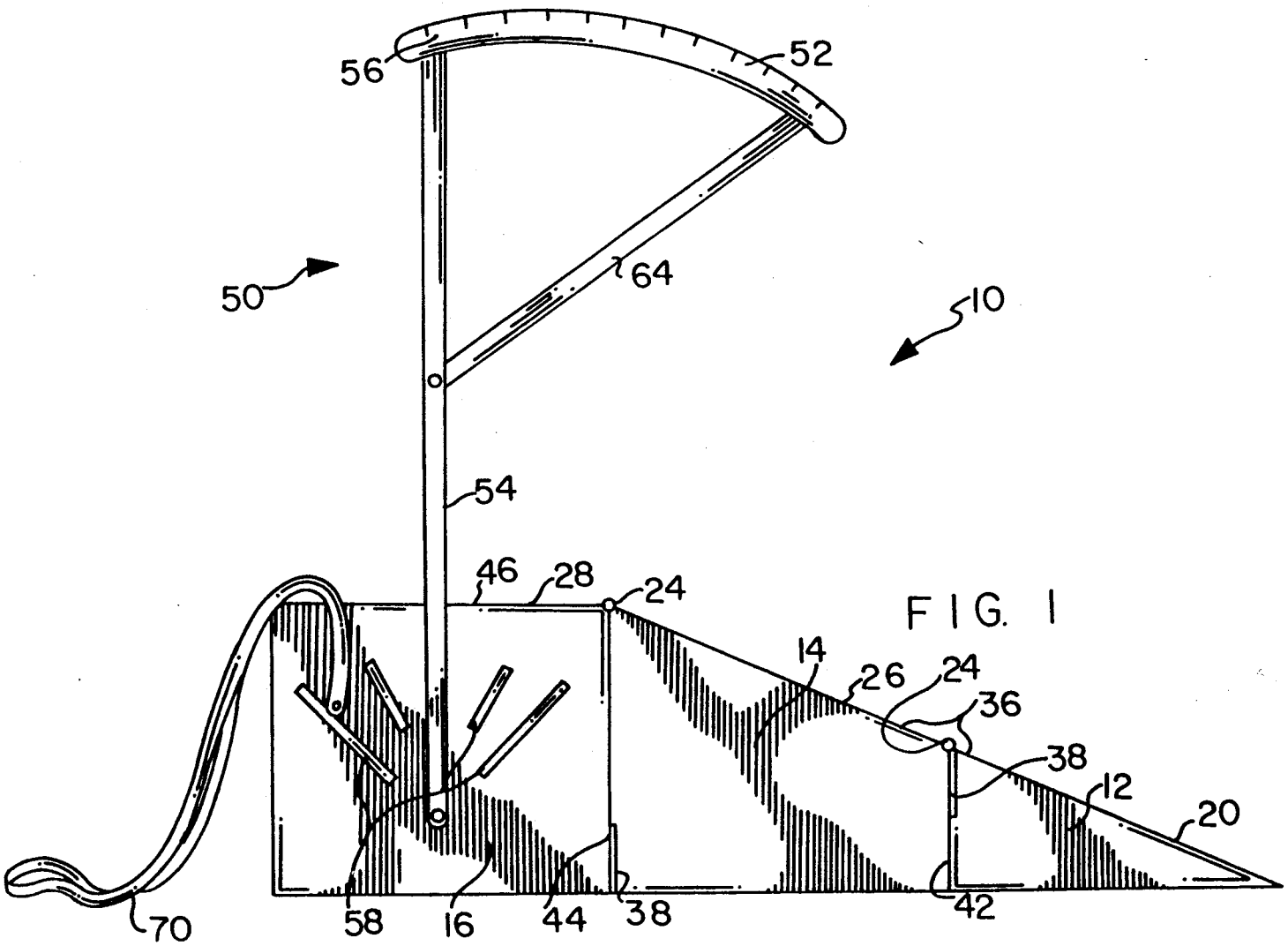
FIG. 1 is a side projection view of the preferred embodiment of the inventive beach lounge in the open position, including the optional canopy assembly and shoulder strap.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
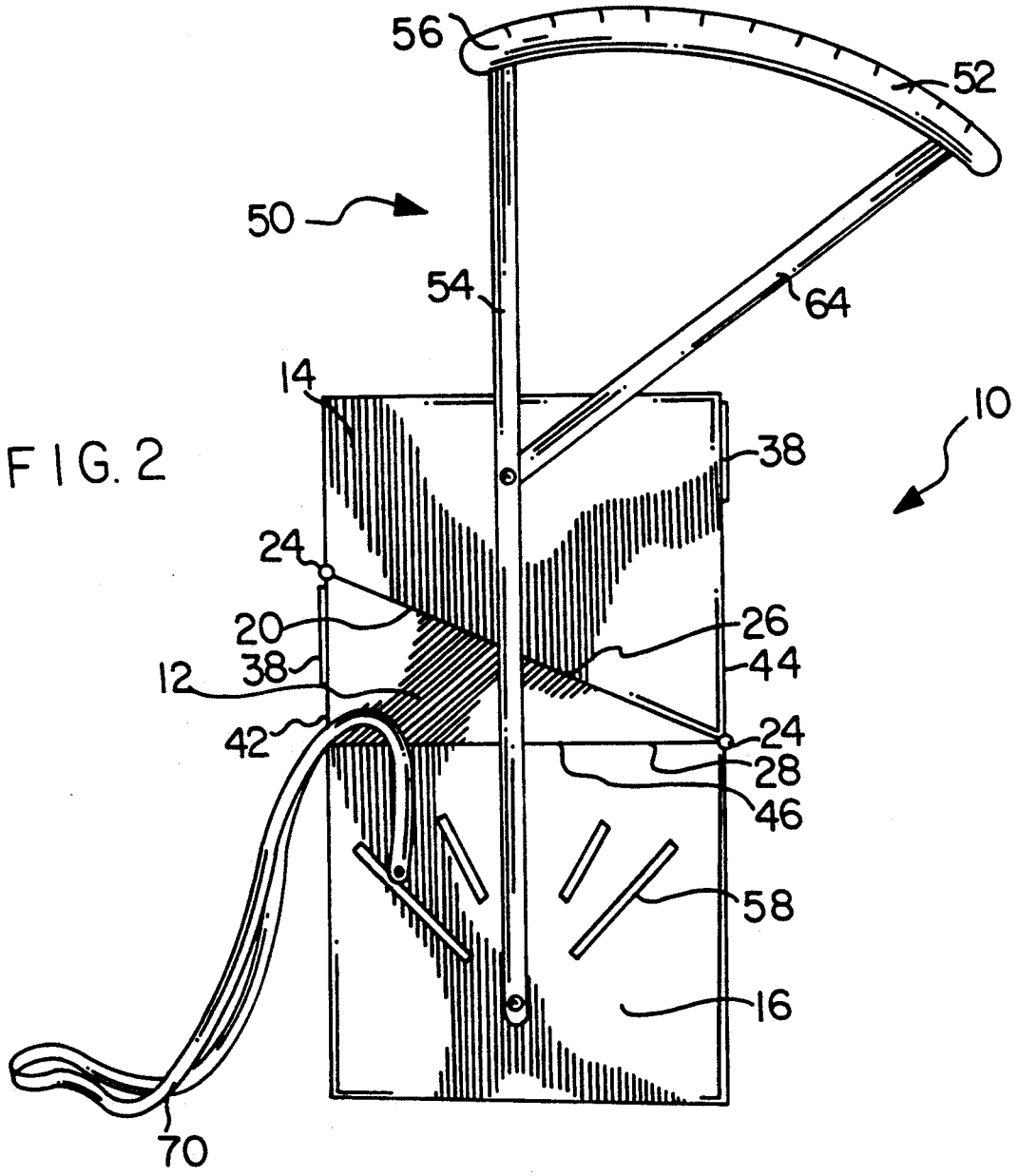
FIG. 2 is a side projection view of the preferred embodiment of the inventive beach lounge in the closed position, including the optional canopy assembly and shoulder strap.
Figure 3:
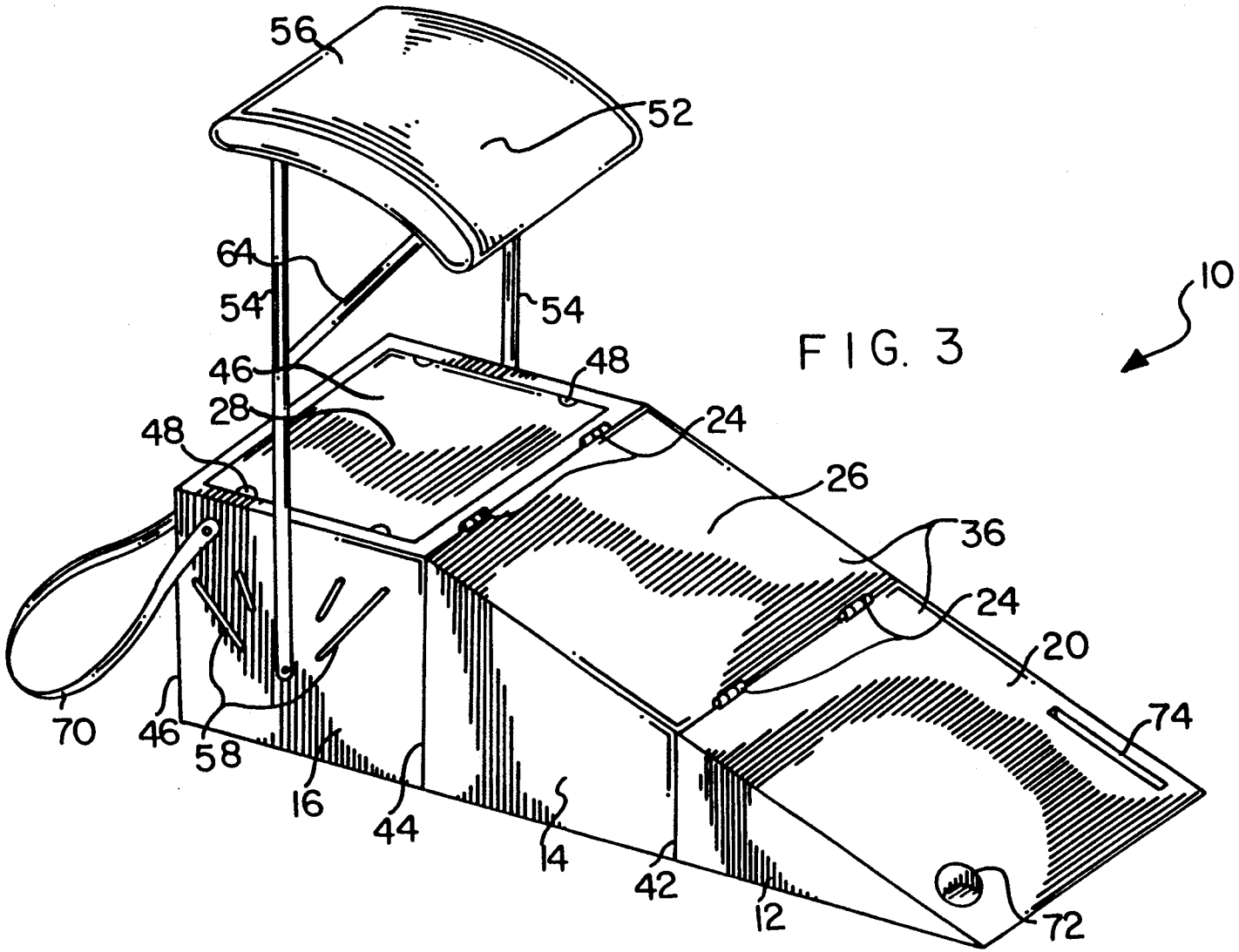
FIG. 3 is a perspective view of the open lounge of FIG. 1.

Referring to FIGS. 1, 2 and 3, a beach lounge or chair 10 is disclosed which includes a series of hingedly connected carrying containers 12, 14, and 16 which can be pivoted relative to each other into an open position for use, and into a closed position for carrying and storage. For purposes of this application, the terms "lounge" and "chair" shall be used interchangably to indicate a furniture item against which a person can lean and rest.

First container 12 has an inclined top wall 20 sloping to ground level, joined with hinges 24 to second container 14, which has an inclined top wall 26 aligned and continuous with top wall 20, the top wall 26 sloping downward and toward first container 12. Second container 14 is joined with hinges 24 to third container 16, which is essentially cubical and has a horizontal top wall 28.

Inclined top walls 20 and 26 form a continuous surface sloping from top wall 28 to the ground, for use as a back rest portion 36. The chair occupant sits on the soft beach sand and leans back against back rest portion 36. Drinks or other items can be placed on horizontal top wall 28 so that they stand upright and are out of the sand.

Figure 4:
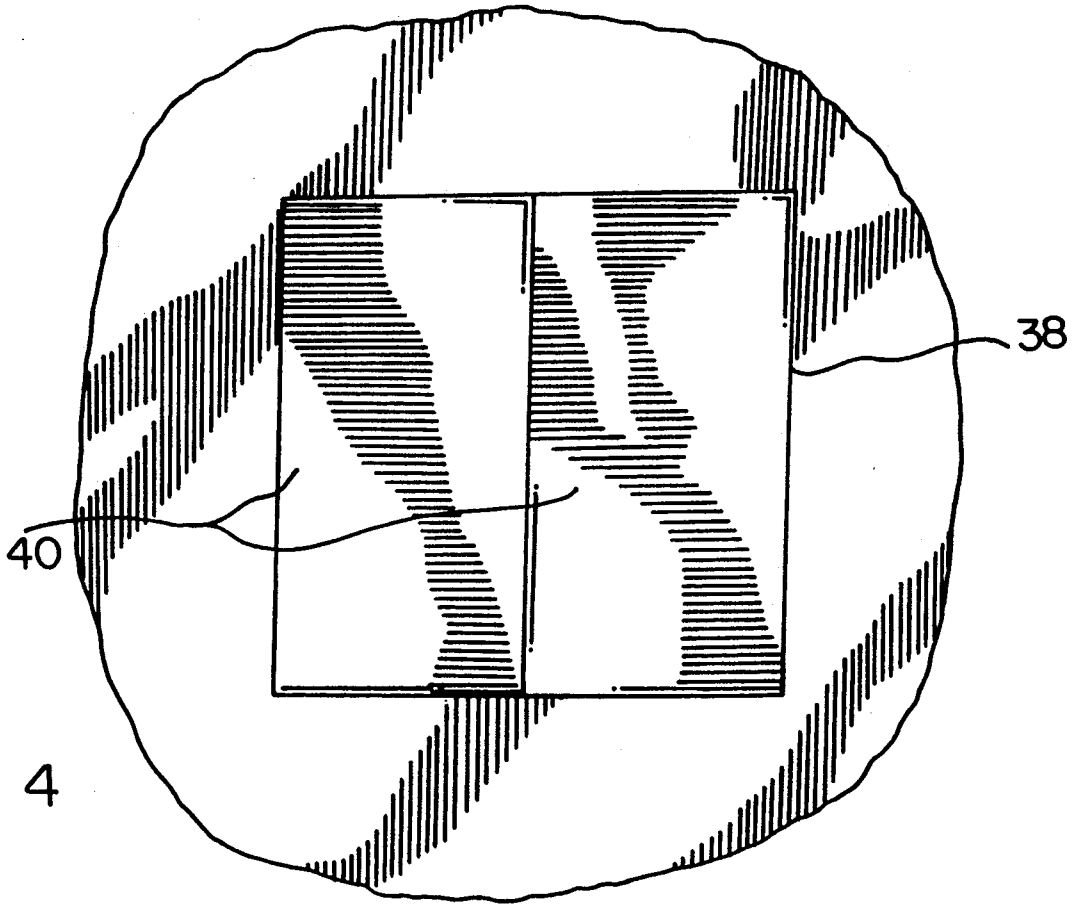
FIG. 4 is a close-up view of an access opening and the split sheet covering.

Containers 12 and 14 have access openings 38 covered with resilient, flexible sheets 40 split into adjacent half portions. See FIG. 4. Openings 38 may be located on any container wall. However, an opening 38 is preferably located on back wall 42 of container 12 and back wall 44 of container 14. In this way, openings 38 are accessible when chair 10 is closed, so that chair 10 can be loaded and carried, and opened only upon arriving at the desired use location. Container 16 is preferably an insulated cooler having an inset, flush lid 46 with finger grip openings 48.

A canopy assembly 50 is preferably provided, and includes a canopy member 52 in the form of a flexible sheet. See FIGS. 1, 2, and 3. Member 52 is mounted to a pair of f irst elongate members 54 at one member 52 end 56. Members 54 are pivotally joined to opposing sides of third container 16. The other end 62 of canopy member 52 is mounted to a pair of second elongate members 64 pivotally joined to first elongate members 54. First elongate members 54 are pivoted relative to third container 16 over stop ridges 58 to position canopy member 50 over the chair occupant. First and second elongate members 54 and 64 are pivoted apart to open canopy member 52 and together to close canopy member 52, over back rest portion 36.

Also preferably included is a shoulder strap 70 attached to opposing sides of first container 12 for carrying chair 10. See FIG. 1. The length of shoulder strap 70 is adjustable and preferably sufficient to lift chair 10 just a few inches off the ground, so that lifting is minimized.

Optional features in container 12 include a circular opening 72 for securely retaining a beverage can and a book or magazine slot 74 for securely retaining reading material.

Method

In practicing the invention, the following method may be used. Chair 10 is closed by pivoting top wall 20 of first container 12 onto top wall 26 of second container 14. Then, containers 12 and 14 are pivoted onto top wall 28 of third container 16. Chair 10 is opened by pivoting first and second containers 12 and 14 off third container 16 and against the ground. Then, first container 12 is pivoted off second container 14 and against the ground.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A portable lounge, comprising:

a first container for retaining items, said first container comprising three substantially vertical side walls and a substantially horizontal bottom wall, and an inclined top wall for use as a back rest, a second container for retaining items, said second container comprising four substantially vertical side walls and a substantially horizontal bottom wall and an inclined top wall, and being hingedly connected to said first container such that said first container can pivot onto said inclined top wall of said second container such that said first container and said second container together form a rectangular parallelepiped structure, said inclined top wall of said second container being alignable with said inclined top wall of said first container for use together as a back rest.

2. A portable lounge according to claim 1, additionally comprising:

an access opening in said first container for inserting items into and taking items out of said at least one container, a resilient sheet having an access slit, for covering said access opening so that said items do not fall out.

3. A portable lounge according to claim 1, additionally comprising:

a canopy assembly comprising two first elongate members joined to opposing sides of said first container, a sheet of flexible material for providing shade, and means for opening and closing said sheet over said first container.

4. A portable chair according to claim 1, additionally comprising:

shoulder strap means for use in carrying said portable chair.

5. A portable lounge, comprising:

a first container for retaining items, said container comprising an inclined top wall for use as a back rest, a second container for retaining items, said second container comprising a substantially horizontal top wall and being connected to said first container such that said first container can pivot onto said substantially horizontal top wall of said second container.

6. A portable lounge according to claim 5, additionally comprising a canopy assembly comprising two first elongate members joined to opposing sides of one of said containers, a sheet of flexible material for providing shade, means for opening and closing said sheet over said first container.

7. A portable lounge, comprising:

a first container for retaining items, said container comprising an inclined top wall for use as a back rest, a second container for retaining items, said second container comprising an inclined top wall and being hingedly connected to said first container such that said first container can pivot onto said inclined top wall of said second container, said inclined top wall of said second container being alignable with said inclined top wall of said first container for use together as a back rest, a third container for retaining items, said third container comprising a substantially horizontal top wall and being connected to said second container such that said second container can pivot together with said first container onto said substantially horizontal top wall of said third container.

8. A portable lounge according to claim 7, additionally comprising:

a canopy assembly comprising two first elongate members joined to opposing sides of one of said containers, a sheet of flexible material for providing shade, means for opening and closing said sheet over said first container.

9. A portable lounge, comprising:

a first container for retaining items, said container comprising an inclined top wall for use as a back rest, a second container for retaining items, said second container comprising an inclined top wall and being hingedly connected to said first container such that said first container can pivot onto said inclined top wall of said second container, said inclined top wall and said second container being alignable with said inclined top wall of said first container for use together as a back rest, an access opening in at least one said container for inserting items into and taking items out of said at least one container, a resilient sheet having an access slit, for covering said access opening so that said items do not fall out.

10. A portable lounge, comprising:

a first container for retaining items, said container comprising an inclined top wall for use as a back rest, a second container for retaining items, said second container comprising an inclined top wall and being hingedly connected to said first container such that said first container can pivot onto said inclined top wall of said second container, said inclined top wall and said second container being alignable with said inclined top wall of said first container for use together as a back rest, a canopy assembly comprising two first elongate members joined to opposing sides of one of said containers, a sheet of flexible material for providing shade, means for opening and closing said sheet over said first container.

11. A method of closing a portable chair comprising a first container for retaining items, said container having an inclined top wall for use as a back rest, a second container for retaining items, said second container having an inclined top wall and being hingedly connected to said first container such that said first container can pivot onto said inclined top wall of said second container, said inclined top wall of said second container being alignable with said inclined top wall of said first container use together as a back rest, and a third container for retaining items, said third container having a substantially horizontal top wall and being connected to said second container such that said second container can pivot together with said first container onto said substantially horizontal top wall of said third container, for transport and storage, comprising the steps of:

pivoting said first container onto said second container, pivoting said first and second containers onto said third container.

12. A method of closing a portable chair comprising a first container for retaining items, said container having an inclined top wall for use as a back rest, a second container for retaining items, said second container having an inclined top wall and being hingedly connected to said first container such that said first container can pivot onto said inclined top wall of said second container, said inclined top wall of said second container being alignable with said inclined top wall of said first container use together as a back rest, and a third container for retaining items, said third container having a substantially horizontal top wall and being connected to said second container such that said second container can pivot together with said first container onto said substantially horizontal top wall of said third container, for transport and storage, comprising the steps of:

pivoting said first and second containers onto said third container and against the ground, pivoting said first container off said second container and against the ground.

* * * * *